United States Patent [19]

Grupelli

[11] 4,109,958

[45] Aug. 29, 1978

[54] MEDICAL TREATMENT CHAIR

[75] Inventor: Renato Grupelli, Genoa (Quarto), Italy

[73] Assignee: Kaltenbach & Voigt GmbH & Co., Biberach an der Riss, Germany

[21] Appl. No.: 799,691

[22] Filed: May 23, 1977

[30] Foreign Application Priority Data

May 28, 1976 [DE] Fed. Rep. of Germany ... 7617190[U]

[51] Int. Cl.[2] ..... A47C 1/02

[52] U.S. Cl. ..... 297/191; 297/330

[58] Field of Search ..... 200/52 R, 157, 6 A, 200/153 K, 11 J; 297/330, 191, 71

[56] References Cited

U.S. PATENT DOCUMENTS

| | | | |
|---|---|---|---|
| 3,225,156 | 12/1965 | Sahbacker | 200/153 K |
| 3,254,163 | 5/1966 | Wanlass | 200/6 A |
| 3,483,337 | 12/1969 | Johnstone et al. | 200/6 A |
| 3,578,379 | 5/1971 | Taylor | 297/330 |
| 3,866,973 | 2/1975 | Heubeck | 297/330 |
| 3,984,146 | 10/1976 | Krestel | 297/330 |

FOREIGN PATENT DOCUMENTS

| | | | |
|---|---|---|---|
| 569,965 | 6/1945 | United Kingdom | 200/6 A |

*Primary Examiner*—James T. McCall

*Attorney, Agent, or Firm*—Haseltine, Lake & Waters

[57] ABSTRACT

A medical treatment chair, e.g. a dental chair, having a seat portion, a back portion, and manually operable switches mounted on the back portion for electrically controlling the operation of parts of the chair, or medium equipment to be used on a patient on the chair. Mounting locations are provided on the back portion in which respective sets of switches are received. Each switch comprises an actuating element which is pivotable between end switching positions and a neutral position intermediate the end positions, and each actuating element has a convex surface which projects outwardly of the adjacent surface of the chair which surrounds a mounting location in which a set of switches is received. This provides for easy manual manipulation of the switches.

9 Claims, 5 Drawing Figures

Fig. 3
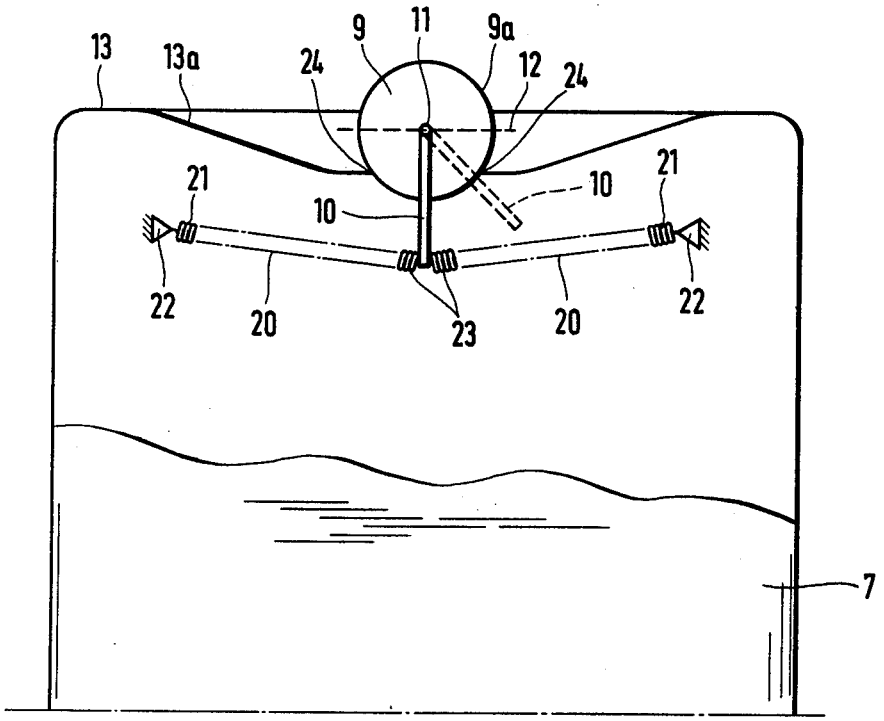
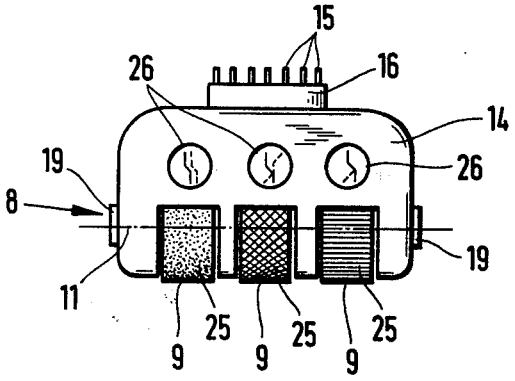
Fig. 4
Fig. 5
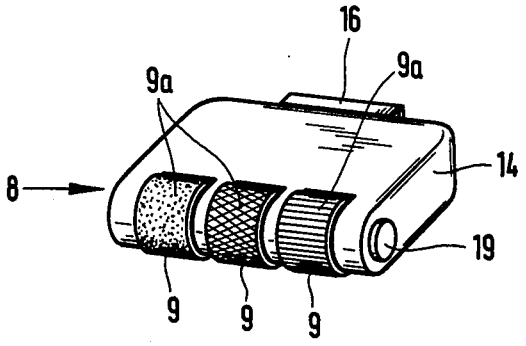

MEDICAL TREATMENT CHAIR

FIELD OF THE INVENTION

This invention relates to a medical treatment chair e.g. a dental chair, having a seat portion, a back portion, and manually operable switches provided on the back portion for electrically controlling the operation of parts of the chair and medical equipment to be used on a patient on the chair, the switches each comprising an actuating element which is pivotable between two end switching positions and a neutral position intermediate the two end positions.

DESCRIPTION OF PRIOR ART

A medical treatment or patient's chair of the above type is known from German Utility Model 7 408 421 and the publication KaVo SD 3000, PR-No 7381/II.73. In this known patient's chair, the actuating element consists of a rocking lever which is sunk in a narrow slot in the backrest and one end of the lever, which is remote from a pivot pin of the lever fitted in the backrest, is flush with the edge of the slot and therefore with the surface of the backrest, so that the doctor or an assistant can only engage this (flush-lying) end of the actuating element with relative difficulty by means of his fingertip, with the result that the control operations are imperfect. Furthermore, because of its sunk arrangement, the flush-lying end of the actuating element is in the range of vision of the doctor or the assistant only when he is in a certain limited number of positions.

It is an object of the invention to provide a medical treatment chair having manually operable switches which can be operated in a reliable and confortable manner and which are clearly visible.

SUMMARY OF THE INVENTION

According to the invention there is provided a medical treatment chair having a seat portion and a back portion and comprising:

manually operable switches mounted on said back portion for electrically controlling the operation of parts of or associated with the chair;

mounting locations provided on said back portion in which said switches are received;

surface portions of the chair surrounding said mounting locations;

a respective actuating element pivotally mounted in each of said switches for movement about a pivot axis between two end switching positions and a neutral position intermediate said end positions;

and a respective convex surface provided on each actuating element and projecting outwardly of the surface portions surrounding the mounting location in which the respective switch is received, said convex surface extending outwardly from a plane containing said pivot axis and extending generally parallel to said surface portions.

The back portion of the chair may comprise a backrest only, or a backrest and an attached head support. The actuating elements can therefore project from the surface of the backrest and/or of the head support. Therefore, subsequent references to the "back portion" should be interpreted in the light of the above definition.

The doctor or assistant is able to move each actuating element with any portion of the inner surface of his finger, and only needs to turn the actuating element a certain extent about its pivot axis by pushing or pulling with the finger in contact with the element. A relatively large surface of the actuating element is available for moving it, so that the element can be engaged and rotated by the finger in all zones. Preferably, the convex surface is profiled, e.g. knurled, and this enables the element to be moved very easily and positively. Thus, the actuating element can be moved, for one and the same switching operation, for example by pushing the finger against one end zone of the projecting part or by pulling with the finger on the other end zone. Because of the fact that it projects, the actuating element is visible to the doctor or an assistant from many more positions taken up by him than with the known chair. If the chair comprises adjustable parts such as an inclinable and vertically displaceable seat and an inclinable backrest, this does not reduce the visibility of the actuating element in the various positions of the chair.

Movement of an actuating element may be further facilitated if it projects from the surface of the side of the upper portion of the chair i.e. the side extending perpendicular to the plane of a back-supporting surface of the back portion.

The actuating element can be arranged on the chair to make it particularly easily accessible to the finger of the doctor or other person using the equipment if said element projects from a switch housing arranged on or in the upper portion the chair, said housing being detachably connected to the upper part of the chair.

It has proved particularly advantageous if the convex surface of the projecting part of the actuating element defines an arc of a circle, this arc subtending an angle of approximately 270°.

A plurality of actuating elements can be arranged side-by-side and can have a common pivot pin. If, for example, in the case of a chair having adjustable parts, three actuating elements are arranged side-by-side, the first element can be used for adjusting the slope of the back portion, the second for adjusting the slope of the seat, and the third for adjusting the level of the seat and the back portion. Movement of an actuating element from the neutral position into one of the end switching positions causes the seat-part concerned to move in one direction, and when the actuating element is moved into the other end switching position on the opposite side of the neutral position, this causes the seat-part concerned to move in the other direction e.g. the first movement of the actuating element causes the seat and back portion to rise, and the second movement of the element causes the seat and back portion to descend.

If push-buttons, which can be depressed towards the pivot pin, are arranged at the side of the actuating element or elements, these push-buttons can each act on a switch which operates a control device by means of which the chair can be brought into a preselected position.

The actuating element can be brought into the neutral position in a particularly advantageous manner by associating, with the actuating element or elements, one or more springs which bias the element or elements towards the neutral position.

BRIEF DESCRIPTION OF THE DRAWINGS

FIG. 3 is a sectional view taken on line III—III in FIG. 1;

FIG. 4 is a plan view of a switch housing for use with the chair shown in FIGS. 1 to 3; and FIG. 5 is a perspective view of the switch housing shown in FIG. 4.

DESCRIPTION OF THE PREFERRED EMBODIMENTS

Figure 1:
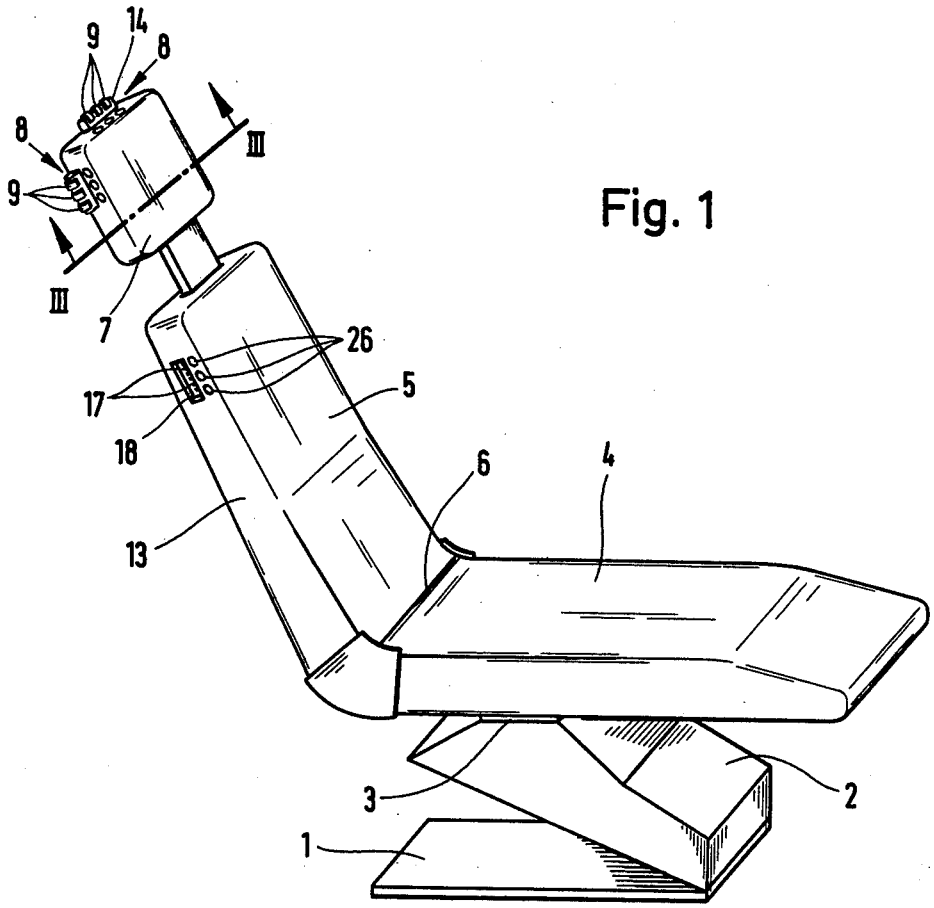
FIG. 1 is a perspective view of a medical treatment chair according to the invention and taking the form of a dental chair.

Referring to FIG. 1, the medical treatment or patient's chair has a pedestal 1, on which is secured a supporting arm 2 which, by way of a support 3, carries the seat 4 and the backrest 5. With the aid of, for example, an electromotive, pneumatic or hydraulic drive, not illustrated, the seat 4 together with the backrest 5 can be displaced in the vertical direction and its slope can be adjusted about the horizontal axis 6. The slope of the backrest 5 can likewise be adjusted about the axis 6.

In the illustrated embodiments, the chair has a back portion comprised by backrest 5 and a headrest 7. However, the back portion may be constituted by backrest 5 alone. In the upper zone of the backrest 5, or on an additional component forming the headrest 7, are detachably fitted manually-operated switches, designated generally by the numeral 8, and consisting of three individual switches, for electrically controlling medical appliances, e.g. the above-mentioned adjustable chair parts 4 and 5, or for moving a dental hand-drill to the right or the left.

Each individual manually-operated switch has an actuating element 9 which can be swung into either of two opposite switching positions about a pivot pin 11 from a median neutral position represented in FIG. 3 in which a stop pin 10 attached to the element 9 is shown in solid lines. In this Figure, the stop pin 10 is shown in broken lines to represent the limit of one of the two switching positions.

Figure 2:
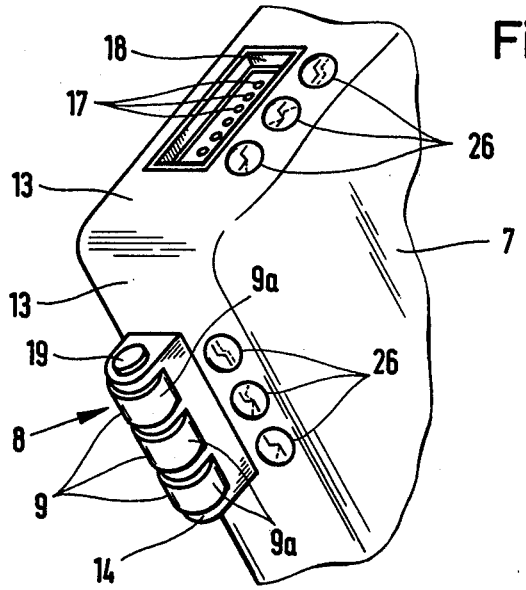
FIG. 2 is a detail view, to a larger scale, of a modified form of the upper end of a head support of the chair as shown in FIG. 1.

The actuating element 9 projects from the surface of the backrest 5 or of the head support 7, the projecting part having a convex surface 9*a* disposed around the pivot pin 11. This convex surface 9*a* extends outwardly from a plane 12 containing the pivot pin 11 and extending parallel to the surface of the backrest 5 or of the head support 7 as shown in FIG. 3. Although not shown, the plane 12 may be co-planar with the adjacent surface portions of the chair, or tangential to the surface portions. As shown in FIGS. 2 and 3, the actuating element 9 projects from the surface of the lateral edge 13 of the backrest 5 or of the head support 7.

As can be seen from FIGS. 1 and 2, the actuating element 9 may project from a switch housing 14 arranged on or in the head support 7 or the backrest 5. FIGS. 4 and 5 illustrate a switch housing 14 which can be detachably connected to the backrest 5 or to the head support 7. For this purpose, the switch housing 14 is provided with a plug 16 which has contact pins 15 and which can be inserted into a socket 18 having contact holes 17 and fitted on the backrest 5 or the head support 7 to provide a mounting location for the switch housing 14. The plug 16 and the socket 18 provide a mechanical releasable connection, whereas the contact pins 15 and the contact holes 17 provide a releasable electrical connection.

Referring to FIG. 3, the convex surface 9*a* of the projecting part of the actuating element 9 projects outwardly of the adjacent surface portions of the chair surrounding the mounting location (18) in which the switches are received. Also, surface 9*a* extends along the arc of a circle disposed around the pivot pin 11. The surface 9*a* of the projecting part of the actuating element 9 that is curved in this way subtends an angle of approximately 270°.

The actuating elements 9 are arranged side-by-side and have a common pivot pin 11. As shown in FIGS. 2, 4 and 5, push-buttons 19, which can be depressed towards the pivot pin 11, are arranged at the side of the actuating elements 9.

As shown in FIG. 3, two tension or compression springs 20 are associated with each actuating element 9, and these springs bias each actuating element 9 towards the neutral position. For this purpose, one end 21 of each of the springs 20 is secured to a fixed point 22 on the backrest 5 or the head support 7, while its other end 23 is secured to the stop pin 10. The stops for the stop pin 10 in the two switching positions are formed by the oppositely disposed edges 24 of a recessed portion 13*a* of the back rest 5 or of the head support 7.

As shown in FIG. 4, the surface of each of the three actuating elements 9 is provided with a profiled configuration 25; this differs from one actuating element to another, one being pimpled, the second knurled and the third grooved.

As can be seen from FIGS. 1, 2 and 4, the actuating elements 9 are marked by symbols 26 which indicate the nature of the control operation associated with the actuating element concerned, e.g. height-adjustment of the seat 4, inclination of the seat 4, and inclination of the backrest 5.

In the upper part of FIG. 3, the section hatching has been omitted so as to make the drawing clearer.

I claim:

1. A medical treatment chair with a seating portion and a back portion having a backrest or a backrest with headrest, comprising;

manually actuated switches, located on said back portion, for electrically controlling operation of part of said chair;

a plurality of mounting locations on said back portion having said switches;

chair surface sections enclosing said locations;

an actuating element located pivotally in each of said switches for movement about a pivot axis between two end switch positions and one neutral switch position between said end positions;

and a convex surface for each actuating element, said convex surface extending outside surface portions surrounding said mounting locations of the switch, said convex surface extending outside a plane containing said pivot axis and parallel to said surface portions.

2. A medical treatment chair according to claim 1, including resilient means coupled with each actuating element to bias the latter to said neutral position.

3. A medical treatment chair as defined in claim 1, wherein said plane containing said pivot axis coincides with said surface portions.

4. A medical treatment chair as defined in claim 1, including: a switch assembly holding a plurality of said switches said switches being detachably located at said mounting locations, said switches having a common pivot axis carrying said actuating elements next to one another.

5. A medical treatment chair as defined in claim 1, wherein each convex surface is a circular arc.

6. A medical treatment chair as defined in claim 5, wherein said arc extends over an angle of substantially 270°.

7. A medical treatment chair as defined in claim 1, including keys associated with said actuating elements and moving parallel to said pivot axis for actuating said switches.

8. A medical treatment chair as defined in claim 1, wherein each convex surface has a profiled shape.

9. A medical treatment chair according to claim 1, wherein said back portion comprises a backrest and a head support, and at least some of said mounting locations are provided on said head support.

* * * * *